United States Patent [19]

Valente

[11] 4,446,711

[45] May 8, 1984

[54] U-BOLT BENDER

[75] Inventor: Raymond L. Valente, Kankakee, Ill.

[73] Assignee: Vale Industries, Inc., Pontiac, Ill.

[21] Appl. No.: 409,061

[22] Filed: Aug. 18, 1982

[51] Int. Cl.[3] ..... B21D 7/08

[52] U.S. Cl. ..... 72/213; 72/308; 72/386

[58] Field of Search ..... 72/213, 220, 126, 127, 72/316, 322, 323, 380, 418, 308, 389; 267/153

[56] References Cited

U.S. PATENT DOCUMENTS

| | | | |
|---|---|---|---|
| 2,339,855 | 1/1944 | Hodil et al. | 72/213 |
| 2,477,910 | 8/1949 | Tal | 72/213 |
| 3,416,348 | 9/1966 | Carter et al. | 72/220 |
| 3,429,157 | 2/1969 | Huth | 72/389 |
| 3,918,286 | 11/1975 | Whitehead | 72/213 |
| 3,929,729 | 12/1975 | Chung | 267/153 |
| 4,053,148 | 10/1977 | Chalmers | 267/153 |

FOREIGN PATENT DOCUMENTS

| | | | |
|---|---|---|---|
| 51-47601 | 1/1976 | Japan | 72/418 |

*Primary Examiner*—Lowell A. Larson
*Assistant Examiner*—Jorji M. Griffin
*Attorney, Agent, or Firm*—Trexler, Bushnell & Wolters, Ltd.

[57] ABSTRACT

One embodiment of an invention providing am inprovement upon a U-bolt bender is disclosed. The bender has a clamp for clamping a workpiece thereto and a slide for advancing the workpiece along a path. The improvement comprises a die and rollers for urging an intermediate portion of the workpiece against a forward surface of the die and for urging end portion of the workpiece respectively against sides of the die adjacent to the forward surface. The bender carries the rollers and the slide carries the die and brings the workpiece into engagement with the rollers by advancing the workpiece along the path. The sides of the die converge together and extend away from the forward surface such that as the slide brings the workpiece into engagement with the roller, the rollers urge the intermediate portion of the workpiece against the forward surface and urge the end portions of the workpiece respectively against the sides of the die, the slide meanwhile causing the clamp to clamp the workpiece to the die. The workpiece initially conforms to the shape of the die; and is made of a resilient material; and upon being released from the die and the rollers, has end portions which spread apart slightly. The sides of the die are oriented such that the workpiece, upon being released from the die and the rollers, has end portions which are in substantially parallel orientation, one end portion to the other.

16 Claims, 16 Drawing Figures

101
89
81
91
87
85
103
79
83
77
105
55
75
31
29
27
25
73
37
63
23
69
65
61
59
57
45
47
53
51
49
21
43

101
89
103
105
77
33
31
75
55
29
27
73
25
71
69
63
23
59
61
65
67
57
45
43
47

91
93
97
99
79
83
87
85
103
98
95
77

91
99
85
103
98
87
97
107

95
91
99
79
85
87
47
103
98
97
77
83
93

101
89
103
105
77
33
31
75
55
29
27
73
25
71
69
63
59
65
61
57
43
45
47
67
109
95
97
87
79
83
91
85
98

U-BOLT BENDER

BACKGROUND OF THE INVENTION

This invention is directed to a novel improvement upon a bending apparatus, and more particularly is directed to a novel improvement upon a U-bolt bender.

U-bolts have many uses. Certain of these uses require that the legs of the U-bolt be substantially parallel. One such use of a U-bolt having substantially parallel legs is for fastening leaf springs to rear axles of vehicles. The nature of such a use often demands that the U-bolt be made of a suitably tough, resilient and springy material.

Use of such a springy material for the manufacture of a U-bolt presents a major problem. Most U-bolts start out being a straight or substantially straight piece or length of bar stock which is later urged into the shape of a U, the legs of the U generally being urged initially into parallel orientation, one leg to the other.

Because of the springy nature of the bolt material, the legs of the U-bolt tend to spread out (slightly) immediately after the U has been formed. Upon such spreading of the legs of the U-bolt, after forming, the legs generally tend to orient ultimately in somewhat anti-parallel orientation in relation to each other. This is generally unacceptable in commercial applications where such legs must be in substantially parallel orientation to each other.

OBJECTS AND SUMMARY OF THE INVENTION

Accordingly, it is a general object of this invention to provide a novel improvement for a U-bolt bender.

A more specific object is to incorporate such an improvement into a U-bolt bender such that the bender is capable of forming a U-bolt having substantially parallel legs.

Briefly, and in accordance with the foregoing objects, one embodiment of the novel improvement for a U-bolt bender will now be summarized. Such a U-bolt bender includes carriage means for carrying a workpiece and slidable means for relatively advancing the workpiece and tooling for causing the bender to form a U-bolt from a substantially springy workpiece.

The invention comprises a die which has an advanceable surface or face and at least two other sides or faces which are contiguous to the advanceable surface and which form opposite sides of the die, and biasly engageable means having rollers or other work engageable elements (at opposite sides of the die) for urging the workpiece against the advanceable surface or face and each of the two opposite sides of the die. The biasly engageable means is mounted adjacent the slidable means which preferably carries the die.

The two opposite sides of the die provide the die with a reverse-taper. Each of the two sides is substantially transversely oriented to the advanceable surface or face of the die. In a preferred embodiment of the die, each of the two sides of the die extends away from the advanceable surface, the two opposite sides converge inwardly together and away from the advanceable surface.

During operation of the apparatus, the slidable means initially urges the workpiece against the advanceable surface of the die and between the roller portions of the biasly engageable means causing spreading of the rollers against the reaction of biasing means. Upon advancement of the slidable means, the converging side surfaces of the die pass between the rollers, and the biasing means causes the rollers to urge end portions of the workpiece against the converging sides of the die.

The two sides of the die converge inwardly in a manner or to a degree such that after end portions of the workpiece are released from the die, the end portions or legs, either initially or ultimately, spring away from each other slightly, but eventually come to a substantially parallel orientation with respect to each other.

BRIEF DESCRIPTION OF THE DRAWINGS

The foregoing, as well as other objects, features and advantages of the invention will become more readily understood upon reading the following detailed description of the illustrated embodiment, together with reference to the drawings, wherein:

FIG. 8 presents a later or intermediate view of such cooperation in the leg-forming of the workpiece;

FIG. 13 presents initial engagement of the workpiece with a clamp prior to the leg-forming of the workpiece;

FIG. 15 presents the biasing element in a somewhat greater state of compression than the compressive state presented in FIG. 4; and, FIG. 16 presents a portion of the biasly engageable means in a disassembled state, the biasing element having been removed therefrom.

DETAILED DESCRIPTION OF THE ILLUSTRATED EMBODIMENTS

Figures 1, 2:
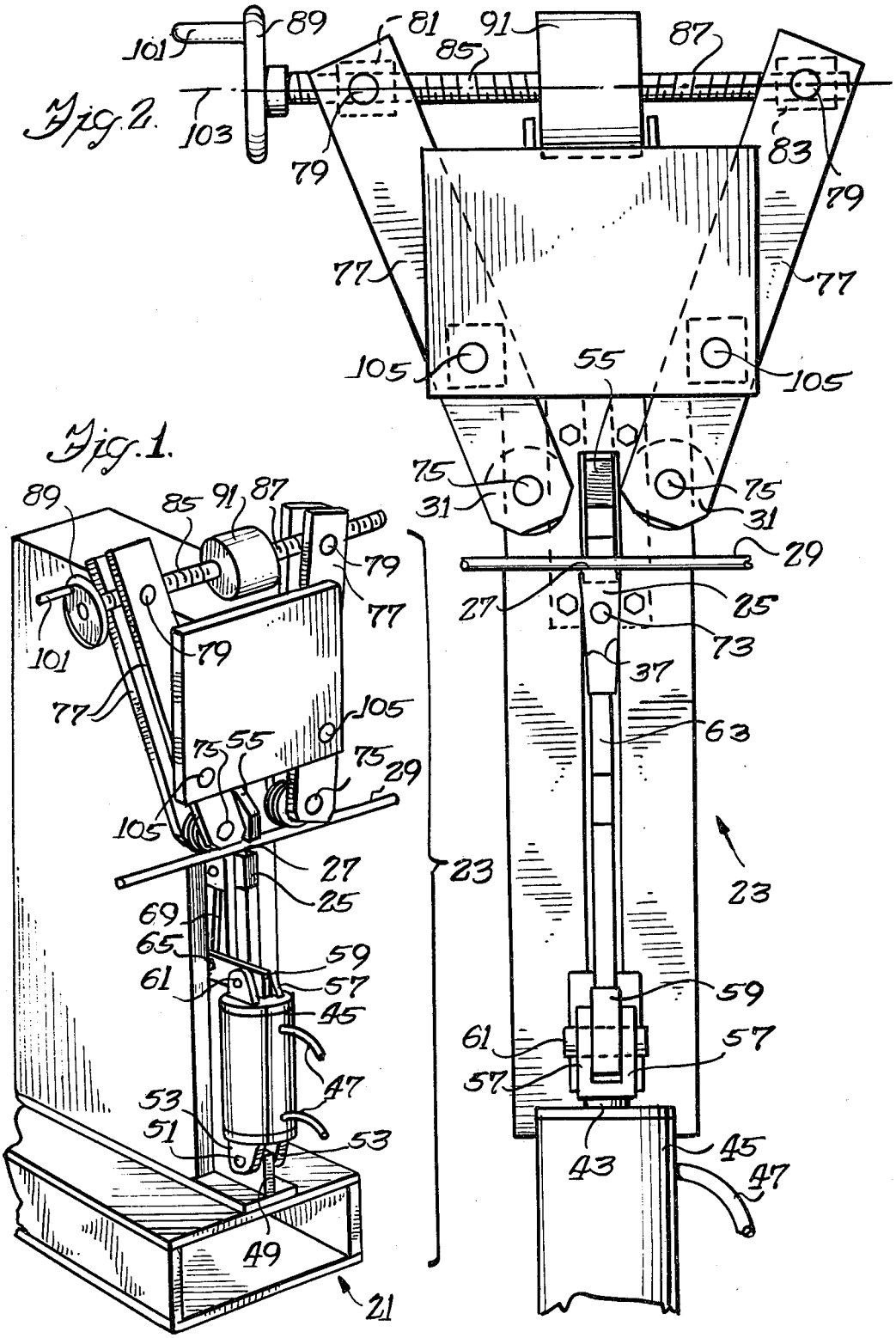
FIG. 1 is a frontal view, in perspective, of a U-bolt bender incorporating one embodiment of the invention.
FIG. 2 is a partial frontal view of the bender and invention.

Referring to the drawings, and initially to FIG. 1, it will be seen that a U-bolt bender, referred to generally by the reference numeral 21 can be adapted to be capable of producing U-bolts having substantially parallel legs, by incorporation of features of the present invention. One such embodiment of the improvement has the elements referred to generally by the reference numeral 23.

The U-bolt bender 21 includes a die 25 having an advanceable surface 27 which functions as a carriage or support means for carrying or holding a workpiece 29 (FIGS. 1–13, 13 and 14). Most of these workpieces 29 are substantially straight initially, but are eventually formed into the shape of a U by the cooperation between the die and other elements of the invention and the bender 21.

Elements of the invention which particularly provide such cooperation are rollers 31 which have been adapted such that grooves 33 formed therein engage the workpiece 29. The roller elements 31 are more fully discussed below.

The U-bolt bender 21 also includes a hydraulically operated piston 43 which is enclosed within a cylinder 45 (FIGS. 2, 3, 13 and 14). Hydraulic fluid, from a hydraulic fluid source (not shown), is supplied to the cylinder 45 via appropriate connections 47 (FIGS. 1–3, 13, 14).

Figures 13, 14, 16:
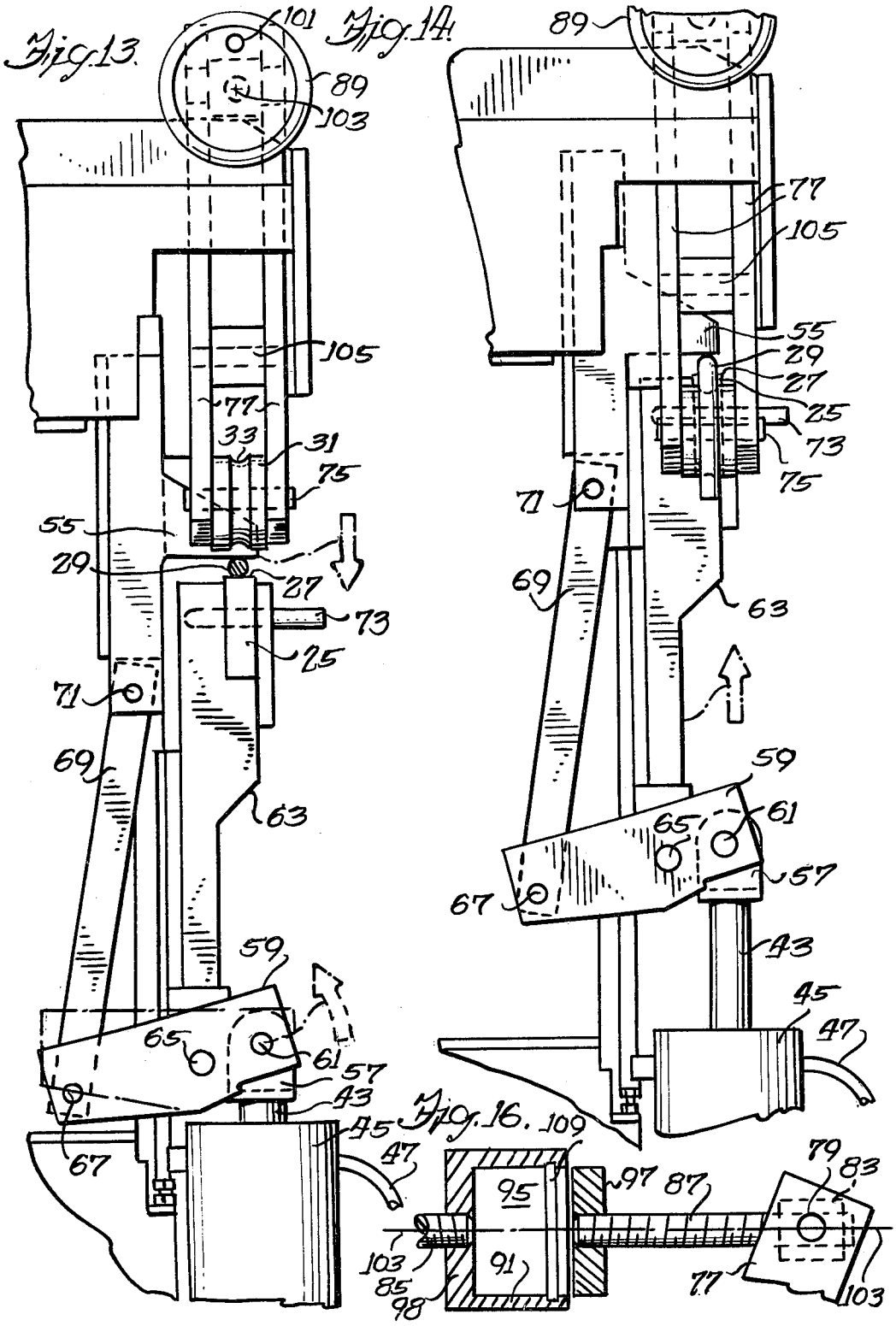
FIG. 13, like FIG. 3, is a side view of one embodiment of the invention, as viewed from the left side of FIG. 2, but unlike FIG. 3.
FIG. 14 presents cooperative engagement of the clamp, the biasly engageable means and the die to form the legs in the workpiece.

A clevis 53 is integral with the base of the cylinder 45. A portion of structural steel 49 (of the U-bolt bender 21) is inserted into an opening or slot between legs of the clevis 53. A pin 51 is inserted through holes (not shown) in the respective legs of the clevis 53 and through a hole (not shown) in the structural steel 49 and thereby secures the base of the cylinder 45 to the bender 21 (FIG. 1). The upper portion of the cylinder 45 is similarly suitably secured to the bender 21 (details not shown) and fixed thereto such that extension or retraction of the piston 43 does not cause the cylinder 45 to move noticeably with respect to the bender 21. Introduction of hydraulic fluid into the cylinder 45 causes the piston 43 to extend outwardly from the cylinder 45 and to move upwardly (FIGS. 13 and 14).

Integral with the surface of the piston 43 (which is exterior to the cylinder 45) is a second clevis 57 (FIGS. 1–3, 13 and 14). One end of a pivotable member 59 is inserted into an opening or slot between legs of the second (or upper) clevis 57 and is secured thereto by a pin 61. An intermediate portion or section of the pivotable member 59 is secured to a slide 63 by a pin 65. The other end of the pivotable member 59 is secured by a pin 67 to one end (the lower end) of an arm 69. The other (or upper) end of the arm 69 is secured by a pin 71 to a clamp 55.

Normal operation of the piston 43 is a two-step procedure. In the first step, hydraulic fluid being forced into the cylinder 45 causes the piston 43 (FIGS. 2, 3) to rise upwardly slightly (FIG. 13) causing the pivotable member 59 to pivot slightly in a counter-clockwise fashion (as viewed in FIG. 13) about the pin 65 drawing the arm 69 and the clamp 55 downward. Such counter-clockwise motion of the pivotable member 59 ceases when the clamp 55 comes in contact with the workpiece 29, the workpiece 29 being supported upon the forward or lead surface 27 of the die 25; and the piston 43 extends upward causing the slide 63 to force the clamped workpiece 29 between the rollers 31. A pin 73 secures the die 25 to the upper portion of the slide 63.

In the first step, therefore, it is the upward motion of the piston 43 which causes the clamp 55 to move downwardly and to clamp or otherwise secure the workpiece 29 to the die 25.

In the second step, the workpiece 29 is formed into a "U". To better understand how the workpiece 29 is formed into a "U", several features of the invention will now be discussed.

Figures 3, 4, 5, 15:
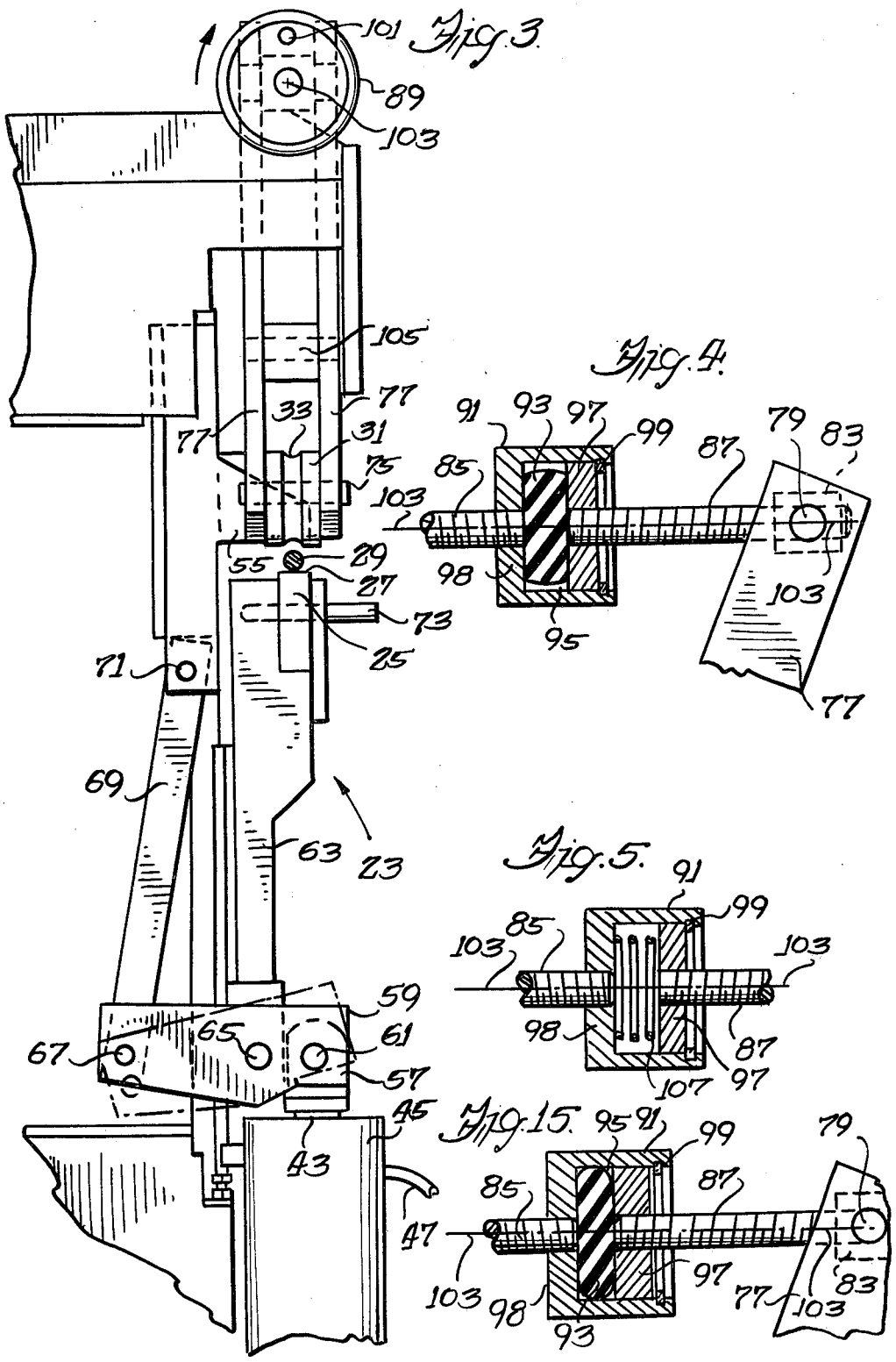
FIG. 3 is a side view of such embodiment of the invention, as viewed from the left side of FIG. 2.
FIG. 4 is a partial view, in section, of a portion of one embodiment of the biasly engageable means of the invention.
FIG. 5 is another embodiment, partially in section, of a portion of such a biasly engageable means.
FIG. 15, like FIG. 4, presents a portion of the biasly engageable means including a biasing element which is in a somewhat compressed state, but unlike FIG. 4.
Figure 6:
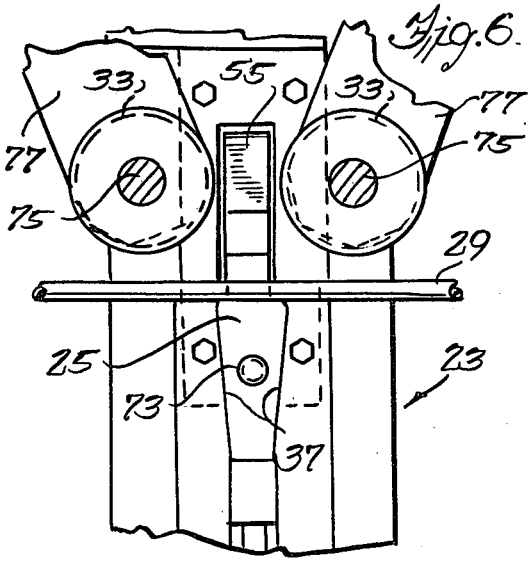
FIG. 6 is a frontal view of one embodiment of a portion of the biasly engageable means, including roller elements, adapted to initially engage the workpiece.
Figure 7:
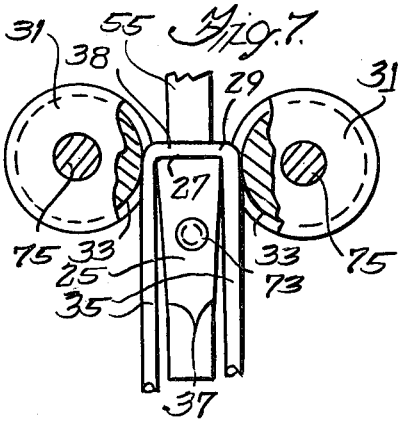
FIG. 7 is a partial view, similar to the view of FIG. 6, in section, and herein being presented to illustrate initial cooperation between the die and the biasly engageable means to form legs in the workpiece.
Figure 8:
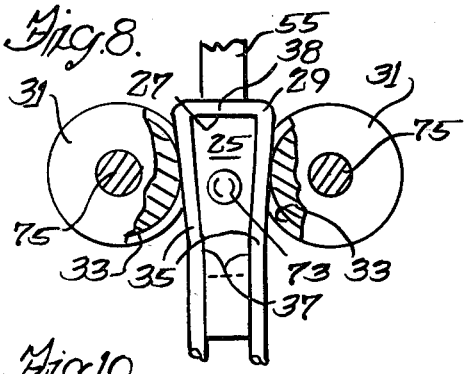
FIG. 8, like FIG. 7, presents the cooperation between the biasly engageable means and the die to form legs in the workpiece, but unlike FIG. 7.
Figure 9:
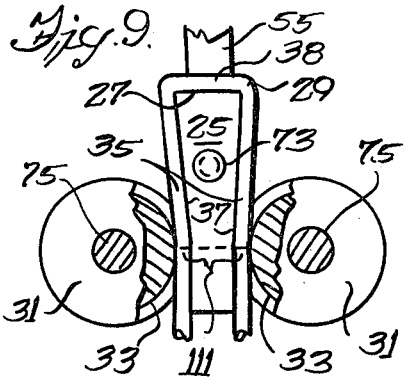
FIG. 9 presents a yet later view of such cooperation in the leg-forming of the workpiece.

Referring to FIGS. 1, 2 and 6–9, it will be seen that the two rollers or work engaging elements 31 (mentioned above) are carried by the bender 21 at opposite sides of the die 25. Each such roller 31 includes a groove or slot 33 (also mentioned above) which has been formed or otherwise cut into a portion of the outer periphery of the roller 31 (FIGS. 3, 6–9). In the illustrated embodiment, a portion of the surface of the groove 33 engages and substantially mates with a portion of the surface of the workpiece 29 (FIGS. 3, 13). The rollers 31 are mounted upon the bender 21 in a manner such that as the slide 63 forces the workpiece 29 upwardly between the rollers 31, the grooves 33 engage the workpiece 29 and the rollers 31 respectively urge end portions or legs 35 of the workpiece 29 individually against a respective one of the two opposite sides 37 of the die 25 (FIGS. 7–9). The clamp 55 and the rollers 31 cooperate to urge an intermediate or base portion 38 of the workpiece 29 against the advanceable surface 27 of the die 25 (FIGS. 7–9 and 14). Contact caused by upward motion of the workpiece 29 (between the rollers 31) causes the rollers 31 to rotate slightly (detail not shown), the groove 33 of each roller 31 meanwhile tracking the workpiece 29.

In the illustrated embodiment of the invention, the rollers 31 cooperate with the die 25 to secure the workpiece 29 to the U-bolt bender 21 during the U-forming step.

Direction is again invited to FIGS. 7–9 for the purpose of discussing one embodiment of such cooperation between the die 25 and the rollers 31. In FIG. 7, the rollers 31 are seen to urge the legs 35 of the workpiece 29 beyond the advancing surface 27 of the die 25 and up against the respective sides 37 of the die 25. When viewing FIGS. 7–9 (and particularly FIGS. 8 and 9), it should be noted that the rollers 31 are forceably being brought together by a feature of the invention which will be discussed below.

The sides 37 (of the die 25) (FIGS. 6–9, 11 and 12) are specifically designed to be in non-parallel orientation to each other, converging toward each other and away from the surface 27 (of the die 25), so that when the workpiece 29 is later released from the bender 21, the finished workpiece 29 (FIGS. 10–12) has legs 35 which are substantially in parallel orientation to each other.

In the illustrated embodiment of the invention, the die 25 thus necessarily has a reverse taper because the resilient or springy nature of the steel or other metal from which the workpiece 29 is usually formed, requires slight overbending in order to obtain substantially parallel legs 35. The amount or degree of reverse taper required is a matter which requires a small degree of experimentation as to a particular grade or type of workpiece stock material to be bent. After a few trial workpieces 29 have been bent by the bender 21, however, the die 25 having the desired reverse taper is usually quickly found.

Figure 10:
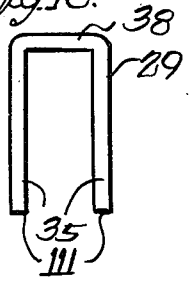
FIG. 10 presents one embodiment of a finished workpiece (or U-bolt) having substantially parallel legs.
Figure 11:
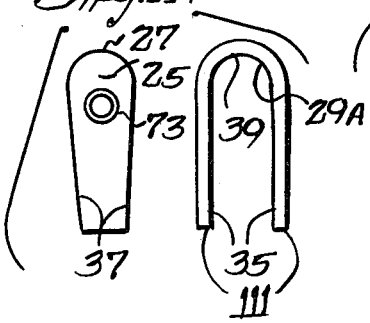
FIG. 11 presents a second embodiment of such a U-bolt, and a corresponding die for manufacture thereof.
Figure 12:
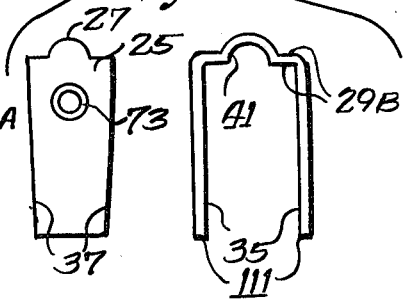
FIG. 12 presents a third embodiment of such a U-bolt, and a corresponding die for manufacture thereof.

Also, the die 25 can have the surface 27 modified as to provide the workpiece 29 with a unique or otherwise highly desirable base or junction portion 38, 39, 41 (FIGS. 10–12). FIG. 10 presents a U-bolt 29 having a substantially squared-bend at the junction 38 of the legs 35. FIG. 11 presents a U-bolt 29A having a substantially rounded-bend at the junction 39 of the legs 35. FIG. 12 presents a U-bolt 29B having a hybrid (a partially squared- and a partially rounded-bend or) base 41.

Although the invention is preferably used in combination with a U-bolt bender 21, it can be appreciated that the features of the invention are readily adaptable to a variety of conventional apparatuses or machines which usually form a workpiece or such from a springy or resilient material where it is highly desirable to have legs, arms, sides or portions of such be in parallel relation to each other.

One important feature of the present invention is that the rollers 31 are adjustable. Each roller 31 is secured by a respective pin 75 (FIG. 2) to one end of a respective roller arm 77 in a manner so as to be rotatable about such pin 75. The pins 75 are carried by the bender 21 in a manner so as to permit the rollers 31 to rotate about such pins 75 as the rollers 31 form the workpiece 29 into a "U" (FIGS. 7–9).

The other end of each roller arm 77 is secured by a respective pin 79 (FIG. 2) to a threaded collar 81, 83 mounted on a threaded shaft 85, 87. One threaded collar 81 has right-hand threads, and the other threaded collar 83 has left-hand threads. The threaded shafts 85, 87 respectively circumferentially carry the threaded collars 81, 83 and have threads which mate therewith.

The right-hand threaded shaft 85 has a hand wheel 89 fixed at one end thereof (FIG. 2). The other end of the right-hand threaded shaft 85 is urged against a housing 91.

The housing 91 is substantially cylindrical in shape (FIG. 1), is substantially hollow internally (FIGS. 4–6 and 16), and is preferably otherwise adapted to enclose a resilient block 93 (FIGS. 4, 15).

The resilient block 93 is compressed within a cavity 95 of the housing 91 by the action of a portion of the left-hand threaded shaft 87 which urges a housing cover 97 against a base 98 of the housing 91, the base 98 being urged in the opposite direction by an end portion of the right-hand threaded shaft 85, thereby compressing the resilient block 93 (in the cavity 95) therebetween. The base 98 is an integral part of the housing 91. The cover 97, however, is not integral with the housing 91, but is axially slidable into the cavity 95.

The resilient block 93 is made of a natural or synthetic rubber, resilient plastic, or other such suitably resilient and compressible substance. The resilient block 93 is inserted into the cavity 95 in a relaxed state, and thereafter is urged into a pre-loaded or compressed state (as discussed above). A ring clamp 99 (FIGS. 4–6, 15) circumferentially engages a slot 109 (FIG. 16), cut or otherwise formed into a portion of the cavity 95 inner periphery, and is used to retain the cover 97 within the cavity 95 (of the housing 91).

The right- and left-hand threaded shafts 85, 87 are colinear and are carried by the bender 21 in a manner such that the turning of a crank 101 (on the hand wheel 89) so that the hand wheel 89 is caused to rotate in a clockwise fashion (FIG. 3) about a longitudinal axis 103 (FIGS. 2, 3) causes the right-hand threaded shaft 85, the housing 91 and the left-hand threaded shaft 87 to also rotate in such a clockwise fashion.

Intermediate portions of each of the two roller arms 77 are individually mounted to the U-bolt bender 21 by respective pins 105 in a fashion such that as the right- and left-hand threaded collars 81, 83 are forced to come together or to spread apart because of the rotation of the respective shafts 85, 87, colinearity of both shafts 85, 87 along the axis 103 is maintained.

It is an appropriate biasing device or element such as the resilient block 93 (discussed above and presented in FIGS. 4, 15), or a spring 107 (FIG. 5), or a hydraulic device (not shown), or the like, together with the cooperation of the clamp 55 and the rollers 31, which provides the presently illustrated embodiment of the invention with the ability to urge a workpiece 29 against the two opposite sides 37 of an appropriate die 25. To achieve such a result, such a biasing device or element is usually inserted into the cavity 95 of the housing 91 in a relaxed state and is thereafter urged into a compressed or preloaded state (FIG. 4).

As the piston 43 moves upwardly, the clamp 55 is drawn downwardly and clamps the workpiece 29 to the surface 27 of the die 25 (FIG. 13). As soon as the clamp 55 makes contact with the workpiece 29, rotation of the pivotable member 59 about the pin 65 terminates and further extension of the piston 43 from the cylinder 45 drives the pivotable member 59 and the slide 63 upward. As the piston 43 progresses upwardly, forcing the die 25 between the rollers 31, the clamp 55 similarly moves upwardly and continues to clamp the workpiece 29 to the die 25 as the workpiece 29 moves upwardly and urges the rollers 31 apart (FIG. 7). Spreading of the rollers 31 causes the biasing element 93 to compress beyond the initially pre-loaded state (FIG. 15). The biasing element 93 is specifically chosen such that as the die 25 and workpiece 29 are further advanced upwardly between the rollers 31, the biasing element 93 causes the right- and left-hand threaded shafts 85, 87 to be urged apart (along the axis 103; see FIGS. 4, 15) thereby causing the rollers 31 to be urged together (FIGS. 8, 9).

Throughout the leg-forming or workpiece-bending procedure, the clamp 55 continues to clamp the workpiece 29 to the surface 37 of the die 25 (FIG. 14). Accordingly, in the illustrated embodiments of the present invention, the legs 35 of the workpiece 29, 29A and 29B are advantageously urged against the two sides 37 of the die 25 (FIGS. 8–9, 11–12), resulting in the finished workpiece 29, 29A and 29B having substantially parallel legs (FIGS. 10–12).

The die 25 forces the workpiece 29 up between the rollers 31 until the legs 35 of the workpiece 29 have achieved a desired length (FIG. 9).

To remove the shaped workpiece 29 from the U-bolt bender 21, the procedure (outlined above) is reversed. The workpiece 29 is thereafter removed from the surface 27 of the die 25 and the legs 35 of the workpiece 29 can be (and preferably are) cut at the ends 111 thereby providing a finished workpiece 29, 29A and 29B (FIGS. 10–12).

What has been illustrated and described herein are the elements of an invention cooperatively combined with the elements of a conventional U-bolt bender, the result being an improved U-bolt bender. While the present invention has been illustrated and described with reference to preferred embodiments, the invention is not limited thereto. On the contrary, alternatives, changes or modifications may become apparent to those skilled in the art upon reading the foregoing descriptions. Accordingly, such alternatives, changes and modifications are to be considered as forming a part of the invention insofar as they fall within the spirit and scope of the appended claims.

The invention is claimed as follows:

1. In a U-bolt bender of the type including support structure, in combination with a workpiece having opposite end portions, said bender further including actuator means carried by said support structure for causing movement of said workpiece along a predetermined path, a die having a surface advanceable along said path and disposed transverse thereto and at least one side surface disposed transverse to and converging away from said die advanceable surface, clamping means for clamping said workpiece to said die, and slide means for moving said die along said path, said slide means carrying said die, wherein the improvement, in combination, comprises: linkage means for pivotally connecting said actuator means to said clamping means, said linkage means being pivotally connected to said actuator means, to said slide means and to said clamping means; roller means carried by said support structure for urging at least one of said workpiece opposite end portions against said die side surface, said roller means being disposed transverse to said path; and biasing means pivotally connected to said roller means for causing said roller means initially spaced from said path by a first dimension to be urged toward said path when spaced from said path by a second dimension relatively less than said first dimension, said actuator means including means for causing movement along said path of one of said die and said roller means relative to the other of said die and said roller means whereby for urging said workpiece against said roller means, wherein said actuator means, said slide means, said clamping means and said linkage means coact to clamp said workpiece to said die thereby producing a clamped workpiece, and wherein said actuator means, said clamping means, said die, said linkage means and said slide means coact to advance said clamped workpiece along said path and to urge said clamped workpiece against said roller means, whereby said roller means engaging said one of said workpiece opposite end portions coacts with said die to urge said one of said workpiece opposite end portions against said die side surface.

2. In a U-bolt bender of the type including support structure, in combination with a workpiece having opposite end portions, said bender further including actuator means carried by said support structure for causing movement of said workpiece along a predetermined path, a die having a surface advanceable along said path and disposed transverse thereto and opposite side surfaces disposed transverse to and converging away from said die advanceable surface, clamping means for clamping said workpiece to said die, and slide means for moving said die along said path, said slide means carrying said die, wherein the improvement, in combination, comprises: first and second linkage means for pivotally connecting said actuator means to said clamping means, one of said first and second linkage means being pivotally connected at a first end portion thereof to said actuator means, being pivotally connected at a second end portion thereof opposite said first end portion to the other of said first and second linkage means, and being pivotally connected intermediate said first and second end portions thereof to said slide means, the other of said first and second linkage means being pivotally connected at a first end portion thereof to said one of said first and second linkage means and being pivotally connected at a second end portion thereof opposite said first end portion to said clamping means; first and second roller means carried by said support structure for urging said workpiece opposite end portions against respective ones of said die side surfaces, respective ones of said first and second roller means being disposed transverse to and on opposite sides of said path; and biasing means pivotally connected to said first and second roller means for causing one of said first and second roller means initially spaced by a first dimension from the other of said first and second roller means to be urged toward said other of said first and second roller means when spaced from said one of said first and second roller means by a second dimension relatively less than said first dimension, said actuator means including means for causing movement along said path of one of said die and said first and second roller means relative to the other of said die and said first and second roller means whereby for urging said workpiece between said first and second roller means, wherein said actuator means, said slide means, said clamping means and said first and second linkage means coact to clamp said workpiece to said die thereby producing a clamped workpiece, and wherein said actuator means, said clamping means, said die, said first and second linkage means and said slide means coact to advance said clamped workpiece along said path and to urge said clamped workpiece between said first and second roller means, whereby said first and second roller means engaging said workpiece opposite end portions coact with said die to urge said workpiece opposite end portions against respective ones of said die side surfaces.

3. The improvement of claim 2 wherein said actuator means includes a hydraulically operated piston enclosed in a cylinder.

4. The improvement of claim 2 wherein said workpiece has predetermined springy qualities; and wherein said die side surfaces converge away from said die advanceable surface in a manner related to said workpiece springy qualities such that said workpiece opposite end portions which initially have been urged by said first and second roller means against said die side surfaces eventually come to a mutually parallel relative relation.

5. The improvement of claim 2 wherein said first and second roller means are threadedly, pivotally connected to a threaded, rotatable shaft carried by said support structure and disposed transverse to said path, said shaft including means for rotating said shaft, whereby said first and second roller means are relatively adjustable transverse to said path for varying said first dimension.

6. The improvement of claim 2 wherein said biasing means includes a block of rubber.

7. The improvement of claim 2 wherein said biasing means includes a block of resilient plastic.

8. The improvement of claim 2 wherein said biasing means includes a spring.

9. Means for forming a workpiece having opposite end portions, used in combination with a U-bolt bender of the type including support structure, actuator means carried by said support structure for causing movement of said workpiece along a predetermined path, a die having a surface advanceable along said path and disposed transverse thereto and at least one side surface disposed transverse to and converging away from said die advanceable surface, clamping means for clamping said workpiece to said die, and slide means for moving said die along said path, said slide means carrying said die, comprising: linkage means for pivotally connecting said actuator means to said clamping means, said linkage means being pivotally connected to said actuator means, to said slide means and to said clamping means; roller means carried by said support structure for urging at least one of said workpiece opposite end portions against said die side surface, said roller means being disposed transverse to said path; and biasing means pivotally connected to said roller means for causing said roller means initially spaced from said path by a first dimension to be urged toward said path when spaced from said path by a second dimension relatively less than said first dimension, said actuator means including means for causing movement along said path of one of said die and said roller means relative to the other of said die and said roller means whereby for urging said workpiece against said roller means, wherein said actuator means, said slide means, said clamping means and said linkage means coact to clamp said workpiece to said die thereby producing a clamped workpiece, and wherein said actuator means, said clamping means, said die, said linkage means and said slide means coact to advance said clamped workpiece along said path and to urge said clamped workpiece against said roller means, whereby said roller means engaging said one of said workpiece opposite end portions coacts with said die to urge said one of said workpiece opposite end portions against said die side surface.

10. Means for forming a workpiece having opposite end portions, used in combination with a U-bolt bender of the type including support structure, actuator means carried by said support structure for causing movement of said workpiece along a predetermined path, a die having a surface advanceable along said path and disposed transverse thereto and opposite side surfaces disposed transverse to and converging away from said die advanceable surface, clamping means for clamping said workpiece to said die, and slide means for moving said die along said path, said slide means carrying said die, comprising: first and second linkage means for pivotally connecting said actuator means to said clamping means, one of said first and second linkage means being pivotally connected at a first end portion thereof to said actuator means, being pivotally connected at a second end portion thereof opposite said first end portion to the other of said first and second linkage means, and being pivotally connected intermediate said first and second end portions thereof to said slide means, the other of said first and second linkage means being pivotally connected at a first end portion thereof to said one of said first and second linkage means and being pivotally connected at a second end portion thereof opposite said first end portion to said clamping means; first and second roller means carried by said support structure for urging said workpiece opposite end portions against respective ones of said die side surfaces, respective ones of said first and second roller means being disposed transverse to and on opposite sides of said path; and biasing means pivotally connected to said first and second roller means for causing one of said first and second roller means initially spaced by a first dimension from the other of said first and second roller means to be urged toward said other of said first and second roller means when spaced from said one of said first and second roller means by a second dimension relatively less than said first dimension, said actuator means including means for causing movement along said path of one of said die and said first and second roller means relative to the other of said die and said first and second roller means whereby for urging said workpiece between said first and second roller means, wherein said actuator means, said slide means, said clamping means and said first and second linkage means coact to clamp said workpiece to said die thereby producing a clamped workpiece, and wherein said actuator means, said clamping means, said die, said first and second linkage means and said slide means coact to advance said clamped workpiece along said path and to urge said clamped workpiece between said first and second roller means, whereby said first and second roller means engaging said workpiece opposite end portions coact with said die to urge said workpeice opposite end portions against respective ones of said die side surfaces.

11. The workpiece-forming means of claim 10 wherein said actuator means includes a hydraulically operated piston enclosed in a cylinder.

12. The workpiece-forming means of claim 10 wherein said workpiece has predetermined springy qualities; and wherein said die side surfaces converge away from said die advanceable surface in a manner related to said workpiece springy qualities such that said workpiece opposite end portions which initially have been urged by said first and second roller means against said die side surfaces eventually come to a mutually parallel relative relation.

13. The workpiece-forming means of claim 10 wherein said first and second roller means are threadedly, pivotally connected to a threaded, rotatable shaft carried by said support structure and disposed transverse to said path, said shaft including means for rotating said shaft, whereby said first and second roller means are relatively adjustable transverse to said path for varying said first dimension.

14. The workpiece-forming means of claim 10 wherein said biasing means includes a block of rubber.

15. The workpiece-forming means of claim 10 wherein said biasing means includes a block of resilient plastic.

16. The workpiece-forming means of claim 10 wherein said biasing means includes a spring.

* * * * *